United States Patent [19]

Maggi

[11] Patent Number: 4,624,201

[45] Date of Patent: Nov. 25, 1986

[54] SEWING MACHINE WITH A BASE CONSISTING OF TWO DETACHABLY CONNECTED MODULES

[75] Inventor: Ezio Maggi, Certosa Di Pavia, Italy

[73] Assignee: Rockwell-Rimoldi S.p.A., Italy

[21] Appl. No.: 808,189

[22] Filed: Dec. 12, 1985

[30] Foreign Application Priority Data

May 27, 1985 [IT] Italy ..... 21971/85[U]

[51] Int. Cl.[4] ..... D05B 1/00; D05B 3/24; D05B 73/00

[52] U.S. Cl. ..... 112/168; 112/220; 112/260

[58] Field of Search ..... 112/220, 260, 168

[56] References Cited

U.S. PATENT DOCUMENTS

| | | | |
|---|---|---|---|
| 2,609,770 | 9/1952 | Christensen | 112/168 X |
| 3,012,532 | 12/1961 | Leslie | 112/220 X |
| 3,025,812 | 3/1962 | Engel | 112/168 X |
| 4,590,875 | 5/1986 | Sanvito et al. | 112/168 |

*Primary Examiner*—Werner H. Schroeder
*Assistant Examiner*—Andrew M. Falik

[57] ABSTRACT

A sewing machine having a base constructed of two modules having coupling means permitting one of said modules to be quickly removed from the other so that different sewing instrumentalities can be substituted to alter the type of stitch being made.

6 Claims, 6 Drawing Figures

10
18
20
11a
33
37
30
43
31
37a
13
39
40
41
45
46
48
47
42
16
44
15
51
50
49
32
38

SEWING MACHINE WITH A BASE CONSISTING OF TWO DETACHABLY CONNECTED MODULES

BACKGROUND OF THE INVENTION

The present invention relates to a sewing machine with a base consisting of two modules connected detachably to each other and, more specifically, of a central module integral with the column of the sewing machine and a base module containing the parts which cooperate with the needle in order to form the stitch.

As is known, the sewing machines currently available are able to carry out various types of stitches, for example, single or double chain-stitches, knotted stitches, etc. Each of these stitches requires that the parts which cooperate with the needle in arranging the sewing thread or threads should have a special structure. These parts are generally housed in the base of the sewing machine, in the zone where the feed dog teeth for feeding the fabric or similar material during sewing are provided.

Many of the known sewing machines have a substantially monolithic structure and, therefore, in order to produce different types of stitches, it is necessary to have different sewing machines. Other currently known sewing machines, however, have a base with a modular structure. This makes it possible to perform various types of stitches using the same sewing machine, replacing only the part where the feed dog teeth are located.

These modular machines have the advantage that they can be assembled and disassembled as required and that they therefore ensure a high degree of operational flexibility with relatively limited expenditure. However, the machines themselves are in many cases unsatisfactory with regard to their operating efficiency and the accuracy of assembly in the areas where the detachable sections are connected to each other. In fact, it must be remembered that, during operation of a sewing machine, the drive shaft performs a very high number of revolutions and the movements of the various parts are such that minimum tolerances are permissible.

It follows that every incorrectly formed or imperfect joint leads to considerable vibration and overheating and also to inacceptable straining of the parts. In practice, if the joints are not perfect, the advantage which these sewing machines have of being of a sectional nature is substantially offset by operational inefficiency and rapid wear of the assembled parts.

In view of this situation, the general object of the present invention is to devise a sewing machine which has a base consisting of two modules connected detachably to each other and which is able to overcome substantially the abovementioned drawbacks.

SUMMARY OF THE INVENTION

Within the context of this general object, an important object of the present invention is to devise a sewing machine which has a simple structure, but which is functional as regards precise operation and a substantially comprehensive performance on account of the interchangeability of the said modules.

These objects and others which will emerge more clearly below are substantially achieved by a sewing machine with a base consisting of two modules connected detachably to each other. These objects and other which will emerge more clearly below are substantially achieved by a sewing machine with the base consisting of two modules connected detachably to each other. The base can be transversely disassembled into a central module and into a base module so as to divide the main shaft, the said shaft and hook operating rod into successive sections.

The joining components forming substantially axially coupling devices are arranged on the facing parts of said successive sections.

DESCRIPTION OF THE DRAWINGS

Further characteristic features and advantages will emerge more clearly from a detailed description of the invention, given by way of a non-limiting example with reference to the attached drawings in which.

DESCRIPTION OF THE PREFERRED EMBODIMENT

Figure 1:
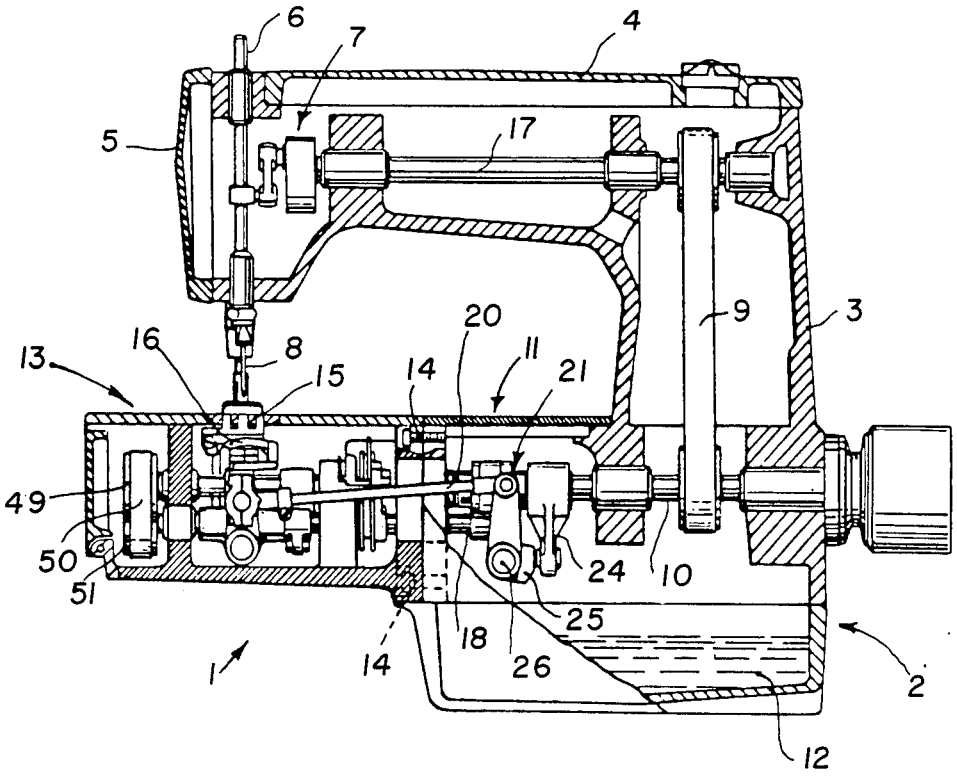
FIG. 1 shows, in elevation and in cross-section, a sewing machine according to the present invention.

With reference to the figures mentioned, the sewing machine according to the present invention is indicated in its entirety by the reference number 1. It consists substantially of a base 2 from which there extends a column 3 supporting, in turn, an arm 4, the end of headpiece 5 of which has a needle bar 6 passing through it. The arm 4 and the headpiece 5 contain a device 7 for actuating the movements of the needle bar 6 and of the needle 8 coaxial therewith. The device is connected via a belt 9 to a main shaft 10 located in the base 2. As FIG. 1 shows, the base 1 consists of a central or service module 11, from the top of which the column 3 extends and which has at the bottom a reservoir 12 for the lubricating oil, and of a base module 13 forming a continuation of the central module 11 and detachably connected to the latter by means of screws 14 for example. the base module 13 has, at the top, feed dog teeth 15 for feeding the fabric and contains all the parts necessary for forming a stitch, in cooperation with the needle 8. In particular, a hook 16 is shown in FIGS. 1 and 2.

The base 2, taken as a whole, comprises in a manner known per se various parts. For example, it comprises the already mentioned main shaft 10, parts for transmitting the movement from the main shaft 10 to an upper shaft 17 connected to the said device 7 for actuating the needle 8, an oscillating side shaft 18 connected via a first kinematic assembly 19 to the main shaft 10, and a hook operating rod 20 connected via a second kinematic assembly 21 to the main shaft 10. The components 10, 18 and 20 are divided into successive sections in the zone where the central module 11 and the base module 13 are joined together.

Figures 2, 5, 6:
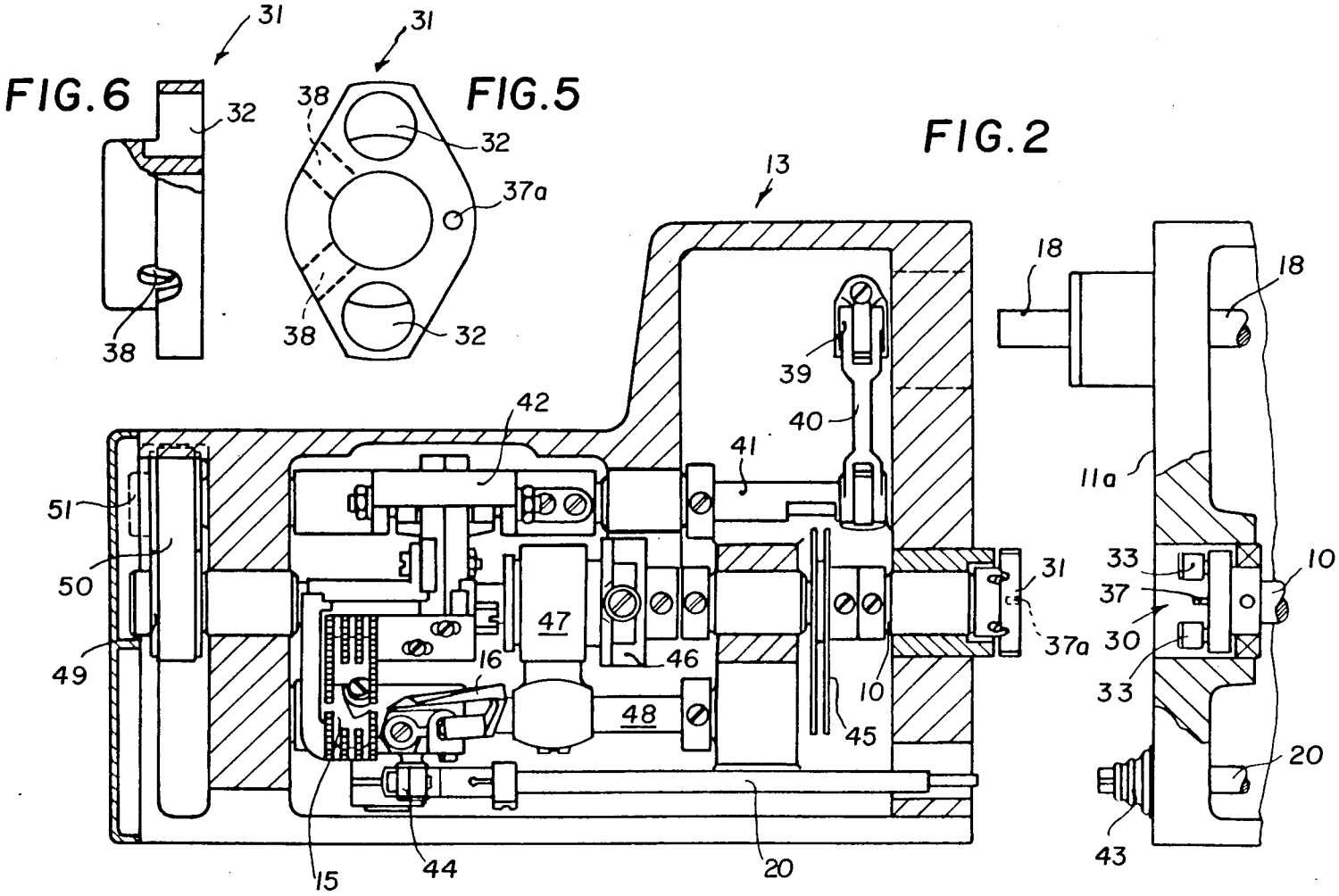
FIG. 2 shows a detailed plan view of a base module containing the parts necessary for forming a chain stitch in cooperation with the needle, facing the central module of the sewing machine.
FIGS. 5 and 6 show a partially sectioned side view and front view of a further detail of a joining component with which the part shown in FIG. 4 is coupled.
Figure 3:
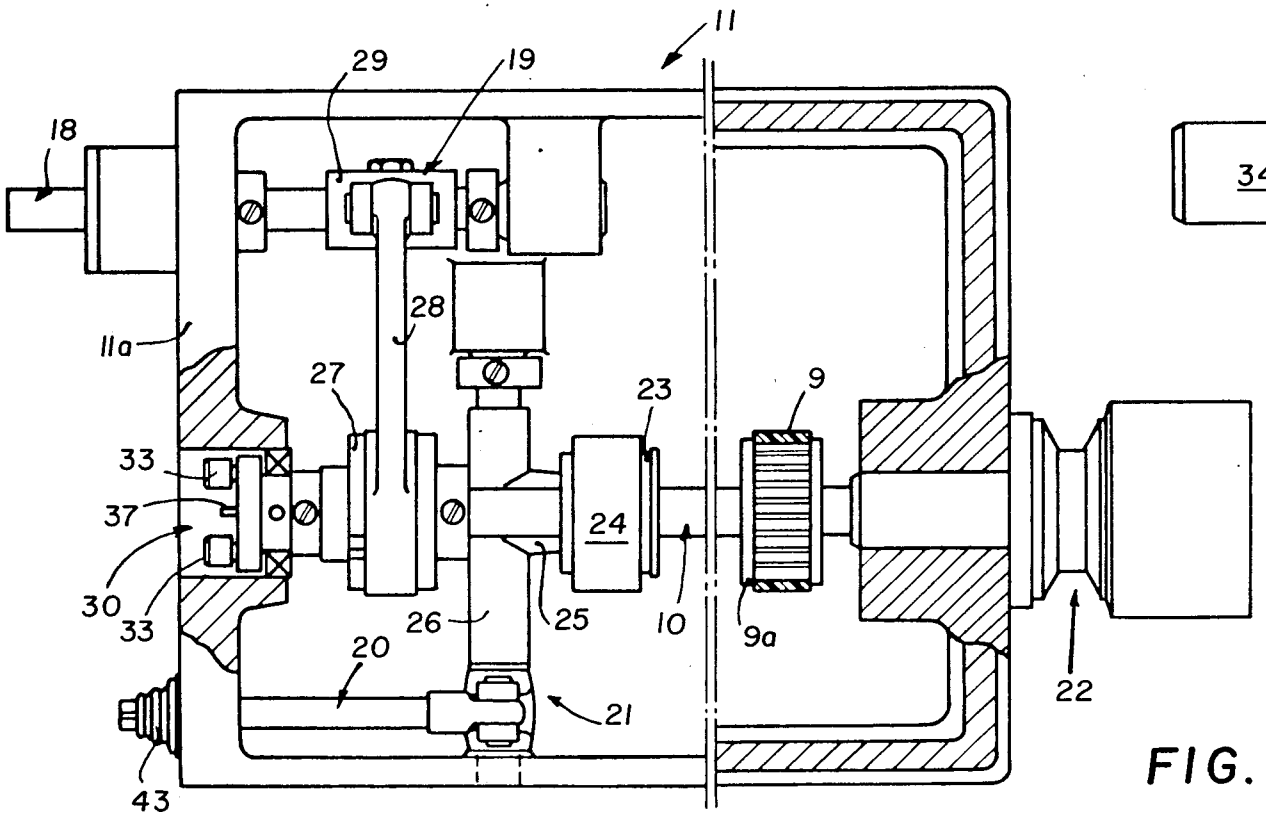
FIG. 3 shows a detailed plan view of the central module of the sewing machine with its respective joining components.

With reference now mainly to FIGS. 2 and 3 which show in detail the parts arranged inside the modules 13 and 11, it can be seen that the main shaft 10 extends from a pulley/handwheel group 22 which can be driven by a motor (FIG. 3) and has first of all a pulley **9*a* for transmitting the movement to the upper shaft 17. the main shaft 10 also operates an eccentric 23 enclosed by a connecting rod 24 (FIG. 1) which extends downwards and is operationally connected to an extension 25 from which a spindle 26 extends in a direction transverse to the main shaft 10**.

The latter forms part of the abovementioned second kinematic assembly 21 ending in the hook operating rod 20.

The main shaft 10 then continues and is connected to a second eccentric 27 operating an arm 28 which, in turn, is connected to a shackle 29 keyed on to the side shaft 18. This forms the said first kinematic assembly connecting the main shaft 10 and the side shaft 18.

Figure 4:
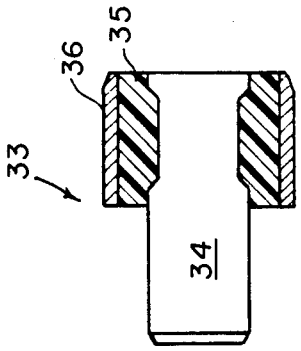
FIG. 4 shows, in isolation and in enlarged cross-section, a detail of a joining component.

The sections of the main shaft 10, side shaft 18 and hook operating rod 20 end, on an edge 11*a* of the central module 11, in joining components forming substantially axial coupling devices shown in detail in FIG. 2. This shows a rapid-engagement coupling 30 comprising a collar 31 (FIGS. 5 and 6) with axial receiving holes 32 arranged diametrically at a distance from each other, and drive pins 33 (FIG. 4) which can be inserted in the receiving holes 32. In an original manner, as shown in FIG. 4, the drive pins 33 consist of studs 34 partially covered with a first layer 35 of soft material, for example rubber, and by a second layer 36 covering and protecting the first layer 35. The second layer 36 is, for example, made of metal and is arranged in the manner of a cylindrical ring. FIG. 3 shows that the rapid-engagement coupling 30 also has a centering pin 37 which can be inserted in the corresponding hole 37*a*, and FIGS. 5 and 6 shows passages 38 for fixing screws. The side shaft 18 engages with a spherical coupling 39 fixed to the base module 13 and connected to a second connecting arm 40. The latter is connected, at its end, to a first feed half-shaft 41 which causes the reciprocating movement of a bracket 42 connected to the aforementioned teeth 15.

The hook operating rod 20, however, has a sleeve coupling and is supported on the face 11*a* of the central module 11 by a rubber element 43. The hook operating rod 20 extends in linear fashion inside the base module 13 as far as a spherical coupling 44 actuating the hook 16.

The main shaft 10, extending beyond the rapid-engagement coupling 30, has mounted on it a lower thread-pulling device 45 comprising cams and, further along it, an eccentric assembly 46 which causes the lateral oscillations of the hook 16 and the eccentricity of which can be adjusted. The eccentric assembly 46 has, in fact, a rod 47 forming a connection with a second spindle 48 aligned substantially with the hook 16 and parallel to the main shaft 10. The hook operating rod 20 and the second spindle 48 actuate all the movements of the hook 16.

Finally, it must be mentioned that the drive shaft 10 has at its end an end pulley 49 connected, via a toothed belt 50, to a second feed half-shaft 51 which, by means of suitable cams and in conjunction with the main shaft 10, causes the upward and downward movements of the teeth 15. The forward and backward movements of the said teeth are actuated by the first feed half-shaft 41, as already mentioned.

The central module 11 described above is an universal-type module which can be constantly retained in the sewing machine 1.

However, the base module 13 is a module especially provided for forming double chain-stitches, i.e. stitch type 401 in Federal Standard Catalog No. 751a. Therefore, the base module 13 may be replaced by another module with different internal parts, which is suitable, for example, for producing a knotted stitch on account of the presence, in particular, of a rotary type hook. Other base modules 13 may be provided for any specific need.

Coupling of a base module 13 with the central or service module 11 depends, obviously, on the previous axial coupling of the various sections of the main shaft 10, side shaft 18 and hook operating rod 20. The coupling devices have a simple design and are extremely effective, in particular, the rapid-engagement coupling 30 which has drive pins 33 covered with soft material ensures smooth transition of the rotational movements and compensates for any imperfections in alignment. the rubber element 43 and the spherical coupling 39 give rise to similar effects.

The said axial coupling devices also have the advantage that they are located relatively far from each other and may therefore have large dimensions.

The invention thus achieves the proposed objects.

All the details may be replaced by technically equivalent elements.

In practice, the materials used, the forms and dimensions may be of any nature or magnitude, as required.

What is claimed is:

1. A sewing machine with a base consisting of two modules connected detachably to each other, of the type comprising inside the said base at least: a rotating main shaft which can be driven by a motor and which is provided with parts for transmitting the movement to an upper shaft located inside the arm of the sewing machine, an oscillating side shaft connected via a first kinematic assembly driven by a first eccentric means on said main shaft and designed to actuate the movements of the feed teeth of the sewing machine, and a hook operating rod connected via a second kinematic assembly driven by a second eccentric means on said main shaft, wherein said second kinematic assembly includes a spindle extending in a direction transverse to the main shaft and located between said first and second eccentric means, and wherein the said base can be transversely disassembled into a central module and into a base module so as to divide the said main shaft, side shaft and hook operating rod into successive sections, and wherein joining components forming substantially axial coupling devices are arranged on the facing parts of the said successive sections.

2. A sewing machine as defined in claim 1, wherein a joining component is arranged on the said main shaft, which component consists of a rapid-engagement coupling substantially comprising a collar with axial receiving holes located diametrically at a distance from each other and drive pins.

3. A sewing machine as defined in claim 2, wherein the said drive pins consist of studs, each of which is partially surrounded by a first layer of soft material and by a second protective layer of hard material.

4. A sewing machine as defined in claim 1, wherein a joining component consisting of a sleeve coupling supported by an element made of rubber or a similar deformable material is provided on the said hook operating rod.

5. A sewing machine as defined in claim 1, wherein a connecting component is provided opposite the said side shaft, which component has a spherical coupling for inserting the end of a section of the said side shaft.

6. A sewing machine as defined in claim 1, wherein the said central module and base module are connected to each other by means of screws.

* * * * *